US010741166B2

(12) United States Patent
Dyreby et al.

(10) Patent No.: US 10,741,166 B2
(45) Date of Patent: Aug. 11, 2020

(54) ADJUSTABLE ACOUSTIC LENS AND LOUDSPEAKER ASSEMBLY

(71) Applicant: Bang & Olufsen A/S, Struer (DK)

(72) Inventors: Jakob Dyreby, Struer (DK); Martin Olsen, Struer (DK)

(73) Assignee: BANG & OLUFSEN A/S, Struer (DK)

( * ) Notice: Subject to any disclaimer, the term of this patent is extended or adjusted under 35 U.S.C. 154(b) by 0 days.

(21) Appl. No.: 16/307,773

(22) PCT Filed: May 23, 2017

(86) PCT No.: PCT/DK2017/050172
§ 371 (c)(1),
(2) Date: Dec. 6, 2018

(87) PCT Pub. No.: WO2017/211365
PCT Pub. Date: Dec. 14, 2017

(65) Prior Publication Data

US 2019/0259372 A1 Aug. 22, 2019

(30) Foreign Application Priority Data

Jun. 9, 2016 (DK) ..... 2016 00340

(51) Int. Cl.

| | |
|---|---|
| ***G10K 11/35*** | (2006.01) |
| ***G10K 11/20*** | (2006.01) |
| ***G10K 11/28*** | (2006.01) |
| ***H04R 1/34*** | (2006.01) |

(52) U.S. Cl.
CPC ..... *G10K 11/357* (2013.01); *G10K 11/20* (2013.01); *G10K 11/28* (2013.01); *G10K 11/352* (2013.01); *H04R 1/345* (2013.01)

(58) Field of Classification Search
CPC ..... G10K 11/357; G10K 11/20; G10K 11/28; H04R 1/345
USPC ..... 381/160
See application file for complete search history.

(56) References Cited

U.S. PATENT DOCUMENTS

2016/0219366 A1* 7/2016 Chapman ..... H04R 1/345

FOREIGN PATENT DOCUMENTS

| | | | |
|---|---|---|---|
| CN | 202282842 | U | 6/2012 |
| JP | 6052196 | A | 3/1985 |
| WO | 03065761 | A1 | 8/2003 |
| WO | 2005081520 | A1 | 9/2005 |
| WO | 2015055763 | A1 | 4/2015 |

OTHER PUBLICATIONS

International Search Report and Written Opinion dated Dec. 14, 2017 in International Application No. PCT/DK2017/050172.
EP Communication Rule 114(2) dated Sep. 19, 2019 in EP Application No. 17728768, 1 page.

* cited by examiner

*Primary Examiner* — Sean H Nguyen
(74) *Attorney, Agent, or Firm* — Berg Hill Greenleaf Ruscitti, LLP.

(57) ABSTRACT

A loudspeaker assembly enabled with means to control the directivity of sound emitted from the loudspeaker and the use of such an assembly in audio rendering equipment. The inventive assembly includes an acoustic lens having movable mechanical means enabling controlled directivity of the sound emitted from the loudspeaker by moving one or more of the movable mechanical means from a first position to a second position.

10 Claims, 12 Drawing Sheets

ADJUSTABLE ACOUSTIC LENS AND LOUDSPEAKER ASSEMBLY

CROSS REFERENCE TO RELATED APPLICATIONS

This application is a national stage application of International Application No. PCT/DK2017/050172, filed May 23, 2017; which claims the benefit of Danish Patent Application No. PA 2016 00340, filed Jun. 9, 2016, the disclosures of each of which are incorporated herein by reference.

BACKGROUND OF THE INVENTION

The present invention relates to a loudspeaker assembly enabled with means to control the directivity of sound distributed from the loudspeaker and to the use of such an assembly in audio rendering equipment.

Loudspeaker assemblies are well-known in the art and within the scope of the present invention, a loudspeaker assembly shall be construed as comprising one or more of the following: one or more loudspeaker transducer units, a cabinet, a chassis, a frame for holding the one or more loudspeaker transducer units and one or more acoustic lenses and optionally a protective cover for the loudspeaker.

Loudspeaker assemblies, although being well-known in the art, all have the features in common that they are constantly exposed such that when sound is emitted no hindrance occurs which may obstruct or distort the sound distribution from the loudspeakers, and also when not in use, they are exposed.

In the art it is known to provide loudspeakers with movable parts. One such example is disclosed in U.S. Pat. No. 7,702,123 B2, wherein a loudspeaker assembly of a modular configuration and wherein one of the loudspeaker units, namely the tweeter unit, is built as an acoustic lens construction comprising a tweeter transducer. The acoustic lens may move up/down, be tilted or rotated in order to redirect the emitted sound. In addition it's desirable for a number of reasons to be able to hide or protect the loudspeakers such that when they are not in use they are not exposed.

In modern loudspeaker rendering systems, acoustic control of the directivity of the emitted sound energy is controlled by digital signal processing means (DSP) to control filters, equalizers and delays.

The current invention discloses an acoustic lens that via movable mechanical means may vary the directivity of the emitted sound energy in a frequency-invariant manner.

A preferred embodiment of the invention with the mechanical controlled acoustic lens/reflector replaces 5-7 DSP controlled traditional loudspeaker transducer units. See the traditional concept as prior art as disclosed by the applicant in WO2015/117616 A1.

The construction and the advantages of acoustic lenses are described for example in U.S. Pat. No. 5,615,176. The particular advantages of redistributing the acoustic energy through an acoustic lens with a very well-defined distribution pattern are achieved with negligible distortion of the signal and independent of the frequency of the sound signal within the frequency range of interest. This is especially relevant when considering the use of the loudspeaker assembly in relation to the listening space in which it is placed and which can have various shapes and dimensions. It is, in this manner, possible to direct the acoustic energy without interference, for example, in the shape of reflections from other surfaces such that the listener will receive a very pure signal i.e. a signal free from unintended distortions, reflections etc. Furthermore, one of the principles in the acoustic lens as disclosed in the document mentioned above is that the sound is redirected into a direction substantially perpendicular to the transducer's sound emitting direction. The overall construction height of the acoustic lens is very limited, such that a complete loudspeaker assembly's construction height comprising both a loudspeaker unit (transducer) and an acoustic lens may be very shallow.

The present invention addresses the desire for a plurality of different controlled directivity settings as compared to what is achieved with the acoustic lens as such by providing a loudspeaker assembly where the assembly includes an acoustic lens, said acoustic lens having one or more movable members, where said movable members may be moved from a first position where the movable members have a first influence on the directivity of the acoustic lens, to a second position where the movable members have a second influence on the directivity of the acoustic lens, and any position in-between said first position and said second position.

The acoustic lens as already discussed above has a very shallow construction height and at the same time provides for a focused sound emission, particularly in the vertical direction. By furthermore providing movable members that can interfere with or control/alter the directivity in the horizontal plane the acoustic lens is able to focus the sound relatively precisely to a listener's position.

In a still further advantageous embodiment of the invention a sound transducer is arranged adjacent the acoustic lens, for emitting sound in a first direction, and where the movable members rotate around one or more axes parallel to the first direction.

The movable members are reflecting the emitted sound and as such the shape of the movable members is important. Therefore, the invention in a further advantageous embodiment provides that the movable members have a front surface having an extent in the direction of the first axis and an extent radially to said first axis where the movable members in the radial direction to the first axis have a curved shape.

The curved shape foresees that interference from reflection of the movable members may be avoided by careful design of the curved shape. One preferred curved shape is convex when seen from a listening position.

In order to control the movement of the movable members the invention provides for electromechanical means to control the movable members such that they are positioned correctly and as desired. The electromechanical means may further be controlled by a remote control through a control unit in the loudspeaker assembly or in the audio system to which the loudspeaker assembly is connected such that a listener in a remote position may change the position of the movable members in order to obtain the optimal sound reproduction from that particular listening position. To make this operation easier for the listener, different preset positions of the movable members may be selectable through interaction with said control unit. The electromechanical means may for example be a step motor for an electrical actuator or a combination of toothed gearwheels and friction wheels combined with a motor such that operation of the movable members is achieved in a stable and precise manner.

The invention is directed at a loudspeaker assembly where the assembly in a further advantageous embodiment includes one or more low range transducers, one or more midrange transducers, and at least one acoustic lens with high range transducer, where the signals delivered from an amplifier to each of the one or more low range transducers, the one or more midrange transducers, and the at least one acoustic lens with high range transducer is passed through a Finite Impulse Response (FIR) filter and Infinite Impulse Response (IIR) filter for each of the one or more low range transducers, one or more midrange transducers, and the at least one acoustic lens with high range transducer.

By providing filters it is possible to program the filters in such a manner that delays etc. will be perceived by a listener as a change in directivity. Therefore, by being able to program the filters of each and every transducer unit in the loudspeaker assembly it is possible very precisely to determine the directivity and thereby the sound reproduction by the entire loudspeaker assembly.

In one particular embodiment the directivity of the low range and midrange transducers is controlled by the filters (this requires more than one transducer of each type each of which capable of reproducing sound energy with sufficient dispersion in a common frequency range), to have the directivity of those matched with the directivity of the high range transducer, of which the directivity is controlled by the movable members of the acoustic lens.

Alternatively, the directivity of the midrange frequencies could also be controlled by means of a (larger) movable lens and one single transducer instead of using multiple transducers with filter control as explained elsewhere.

A further advantageous embodiment of this loudspeaker assembly is providing the transducers with separate power amplifiers which in a further advantageous embodiment of the invention where the signals after having passed through the Finite Impulse Response (FIR) filter and the Infinite Impulse Response (IIR) filter for each of the one or more low range transducers, one or more midrange transducers, and the at least one acoustic lens with high range transducer are sent to a separate power amplifier connected to each of the one or more low range transducers, the one or more midrange transducers, and the at least one acoustic lens with high range transducer.

This construction provides a very versatile and controllable loudspeaker assembly where the sound may be controlled and reproduced very precisely to any desired listening position.

In the invention the acoustic lens may be dynamically configured to distribute the sound energy in either modes of directivity from being wide to narrow or in between wide and narrow. This is obtained by movement of one or more movable members of the acoustic lens, from one first position of the movable members to another second position of the movable members or to a third position being between the first- and the second position. The movements of two of the movable members correspond to an angle rotation in the range of 0-120 degrees; the two movable members having the same centre of rotation, or rotating about parallel non-coaxial axes. It is also contemplated that the two movable members are provided such that the two members move symmetrically (coupled) or asymmetrically (independently) around their axis.

A further advantageous embodiment provides that the electromechanical means for moving the loudspeaker and/or the acoustic lens objects comprises one or more spindles/arms and/or tooth wheels, these means optionally included into a gear box or appear as individual mechanical objects.

In a still further advantageous embodiment of the invention also relating to moving the acoustic lens from a first non-exposed position and into a second exposed position, the means for moving the loudspeaker and/or the acoustic lens comprises one or more rails fastened to the surroundings, for example inside a loudspeaker assembly housing, as provided for in a further advantageous embodiment where the loudspeaker assembly is arranged in a housing, and where said acoustic lens is retractable into said housing. The means may b e provided on the acoustic lens for sliding along said rails, such that the acoustic lens may be moved between the first and second positions.

Supplemental to the two different embodiments for providing movement of the loudspeaker acoustic lens, the invention in a further advantageous embodiment provides means for moving the loudspeaker where the means comprises one or more moving racks optionally flexible racks fastened to the loudspeaker with corresponding gear wheels, such that by rotating the gear wheels the rack(s) and thereby the loudspeaker will move.

In general any other suitable means for moving the objects of the assembly may be used. As for example a concertino mechanism, comprising a scissors arrangement, whereby elevation/displacement achieved by moving the ends of the scissors' arms together and retraction is achieved by moving the arms apart. Also arranging the assembly in a parallelogram structure, such that the assembly fastened in one corner of the parallelogram will move in a linear manner when the shape of the parallelogram is altered, for example by influence of an actuator fastened to an appropriate part of the construction.

Taking advantage of the lens technology is especially advantageous as distortions and unintended reflections from the ceiling and/or floor might be severely limited in that the well-defined distribution pattern of the acoustic energy through the acoustic lens is very well-defined, making it possible to direct the acoustic energy i.e. the sound substantially unimpeded to the listener.

In a further advantageous embodiment, the inventive principle may be arranged in a television set, a hi-fi sound installation or another loudspeaker. For everyday use, it might be desirable that for example a television set does not have protruding loudspeakers. Whereas in use when the television has a more active role, e.g. when watching prime-time sports events or when watching feature films, where focus is on the screen and not on the design of the television set, it might be more acceptable that extra loudspeakers protrude from such a television set. Especially, if the provision of extra loudspeakers, for example comprising an acoustic lens will greatly improve the sound quality of the transmission/content and thereby improve the user's overall experience. For the same reasons, it might also be desirable to arrange such loudspeaker assemblies in hi-fi sound installations such as so-called ghetto blasters, flat screen TVs (LCD/plasma/OLED), signal receivers, audio/video media players, amplifiers, in-car entertainment systems, laptops, PCs, or other transportable sound equipment.

For some applications, it is desirable to have further possibilities of directing the sound. For this purpose, the loudspeaker assembly in a further advantageous embodiment is arranged such that the loudspeaker assembly and/or the acoustic lens may rotate around the axis of movement. Therefore, by being able to rotate the acoustic lens or the loudspeaker around a second axis, it is possible to direct the sound-energy as optimally as possible towards the listener.

Also by providing rotation of the acoustic lens members around the axis of movement, it might be possible to direct the sound energy with a minimum of distortion and reflections to a listener.

Furthermore, the movements of the members of the loudspeaker assembly and acoustic lens according to the invention, may be carried out in response to instructions received from a computer, wherein input from information about the position of the listener and/or the configuration of the room and/or pieces of furniture etc. may give the instructions to the movable members on how to position or in any other way bring the loudspeaker assembly into the most optimal sound energy transmitting position according to the present circumstances.

In a still further advantageous embodiment of the invention the acoustic lens is provided with light emitting means, where said light emitting means optionally may be controlled to emit different colored light and/or different light intensity corresponding to the loudspeaker's status.

The light may have different colors/hues in order to indicate the state of the speaker, for example a red light may indicate standby status, a green light active status, a pulsating light may indicate that the software in the loudspeaker assembly is being updated etc.

It is also contemplated as disclosed in a still further advantageous embodiment that the assembly includes two acoustic lenses, where a first acoustic lens is provided for higher frequencies corresponding to a treble and a second acoustic lens is provided for mid-tone frequencies. With this configuration it is possible to optimize the sound emission even further. It is well known that low frequencies are difficult to direct and will to a large degree be distributed at very wide emission angles relative to the low frequency speaker. For higher frequencies (mid-tone and high-tone) it is easier to direct the sound emission in a particular direction. By providing both high- and mid-tone speakers with acoustic lenses, and in particular acoustic lenses having movable members, the directivity is increased and hence it is possible to even further improve the sound experience in a particular listeners' position. The midrange acoustic lens will typically have larger physical dimensions than the high tone acoustic lens.

At least within the present invention mid-tone speakers shall be understood as speakers which will typically emit/reproduce sound in the frequency range from 250 to 2000 Hz, tweeters or high tone speakers are usually designed to reproduce sound in the frequency range from approx. 1500 Hz and upwards, and low-tone or bass speakers reproduce sound in the frequency range below 350 Hz. The human ear will typically be able to detect frequencies down to approx. 30-40 Hz.

The invention will now be described with reference to the accompanying drawings, in which.

Figure 6A:
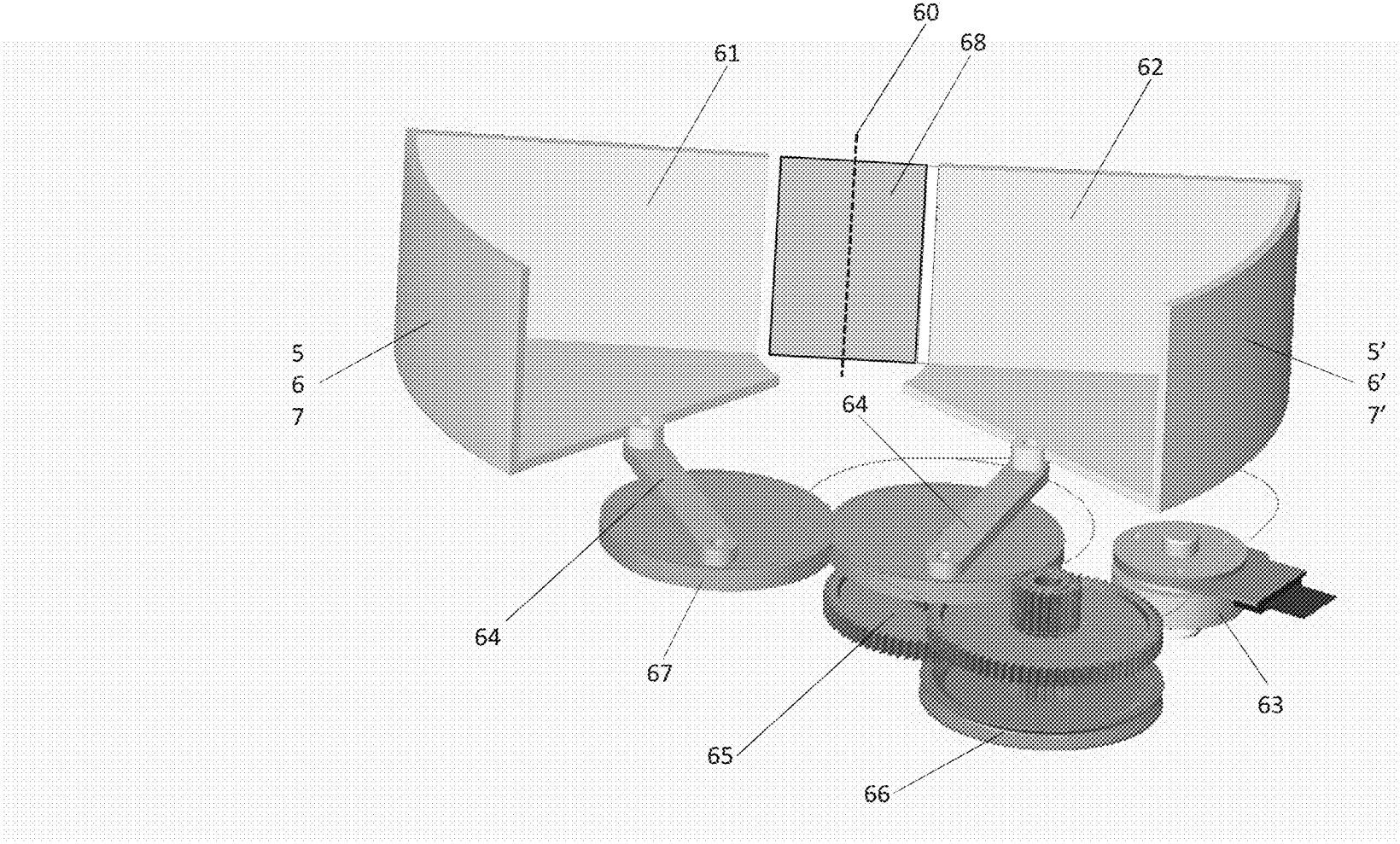

FIG. 6*a* illustrates an example of the movable members of the acoustic lens.

Figure 6B:
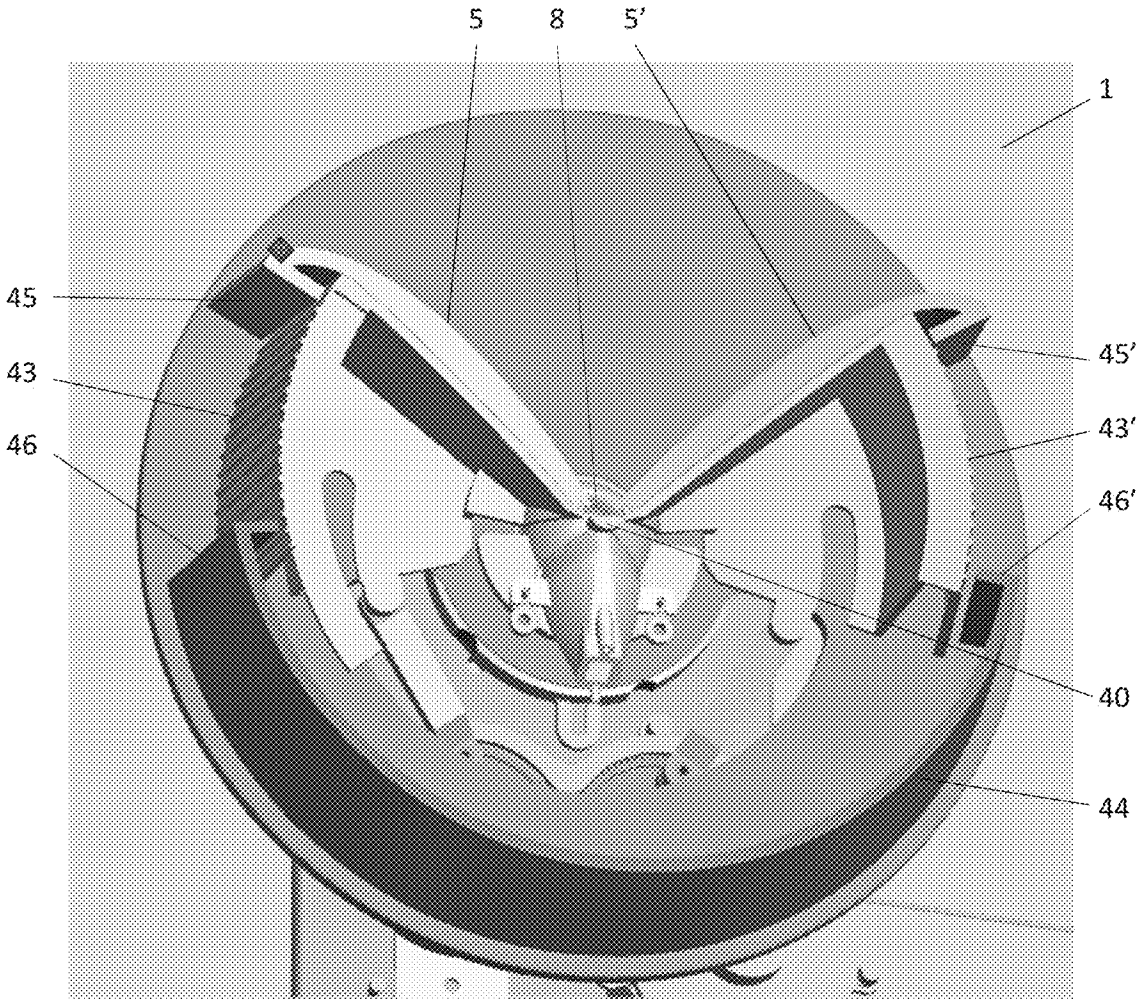

FIG. 6*b* illustrates a view of an acoustic lens where the top of the lens has been removed.

Figure 7:
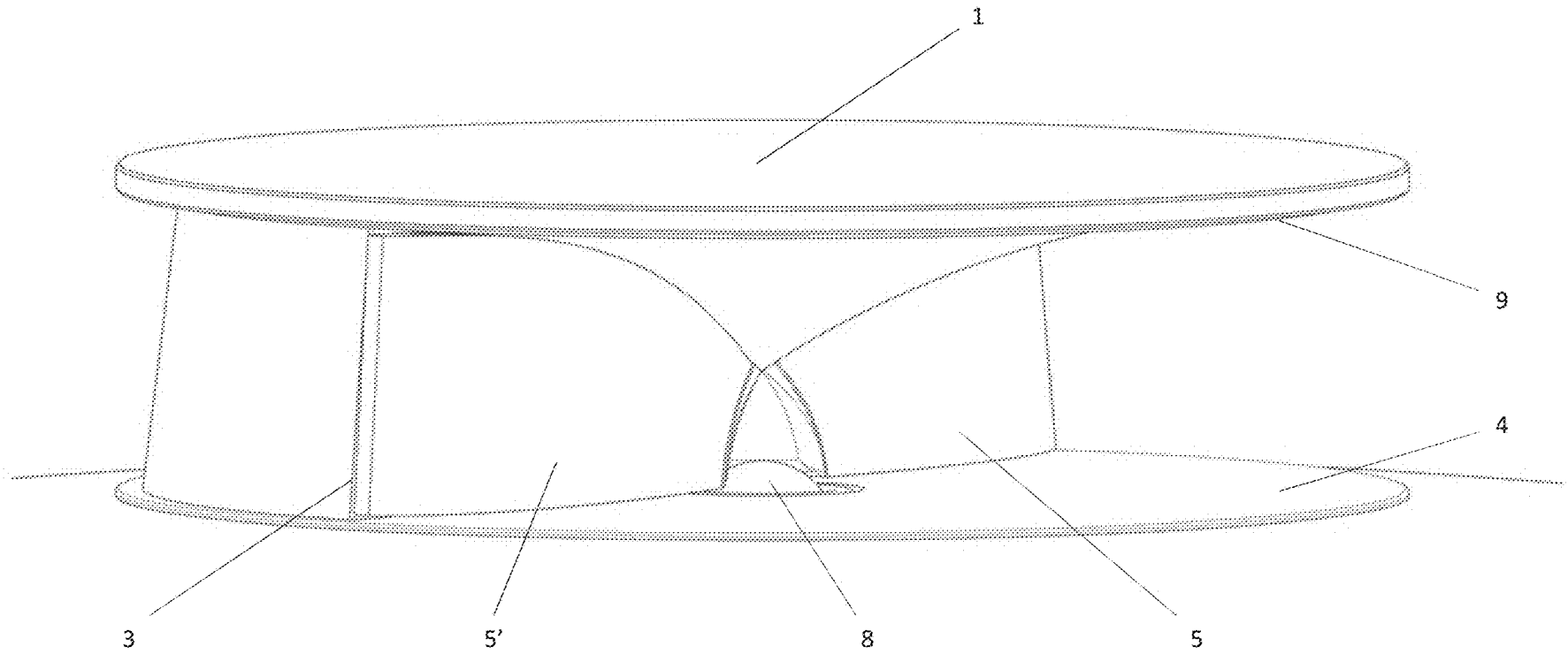

FIG. 7 illustrates a side view of an embodiment of the acoustic lens.

FIG. 8*a* illustrates alternative positions of the movable members according to acoustic lens configurations.

FIG. 8*b* illustrates a top view of optional geometrical shapes of the movable members.

Figure 9:
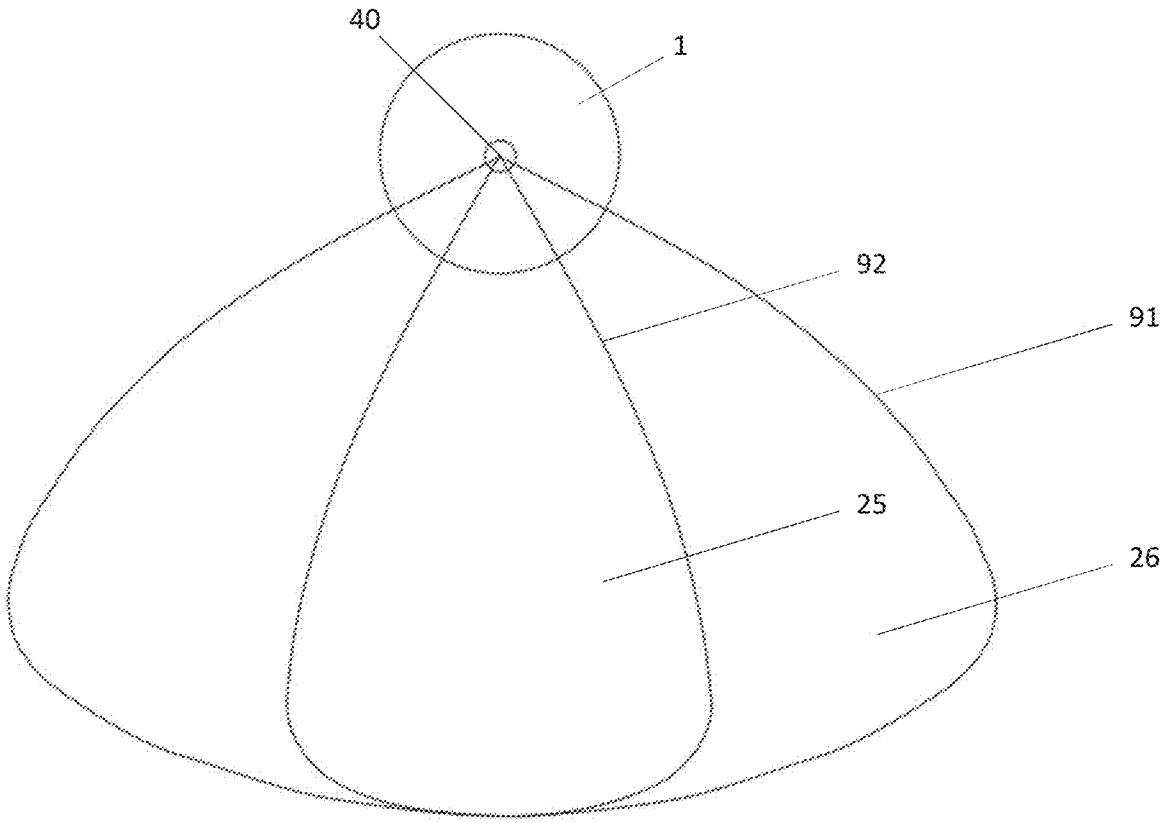

FIG. 9 illustrates sound fields related to wide and narrow modes of directivity.

Figure 10:
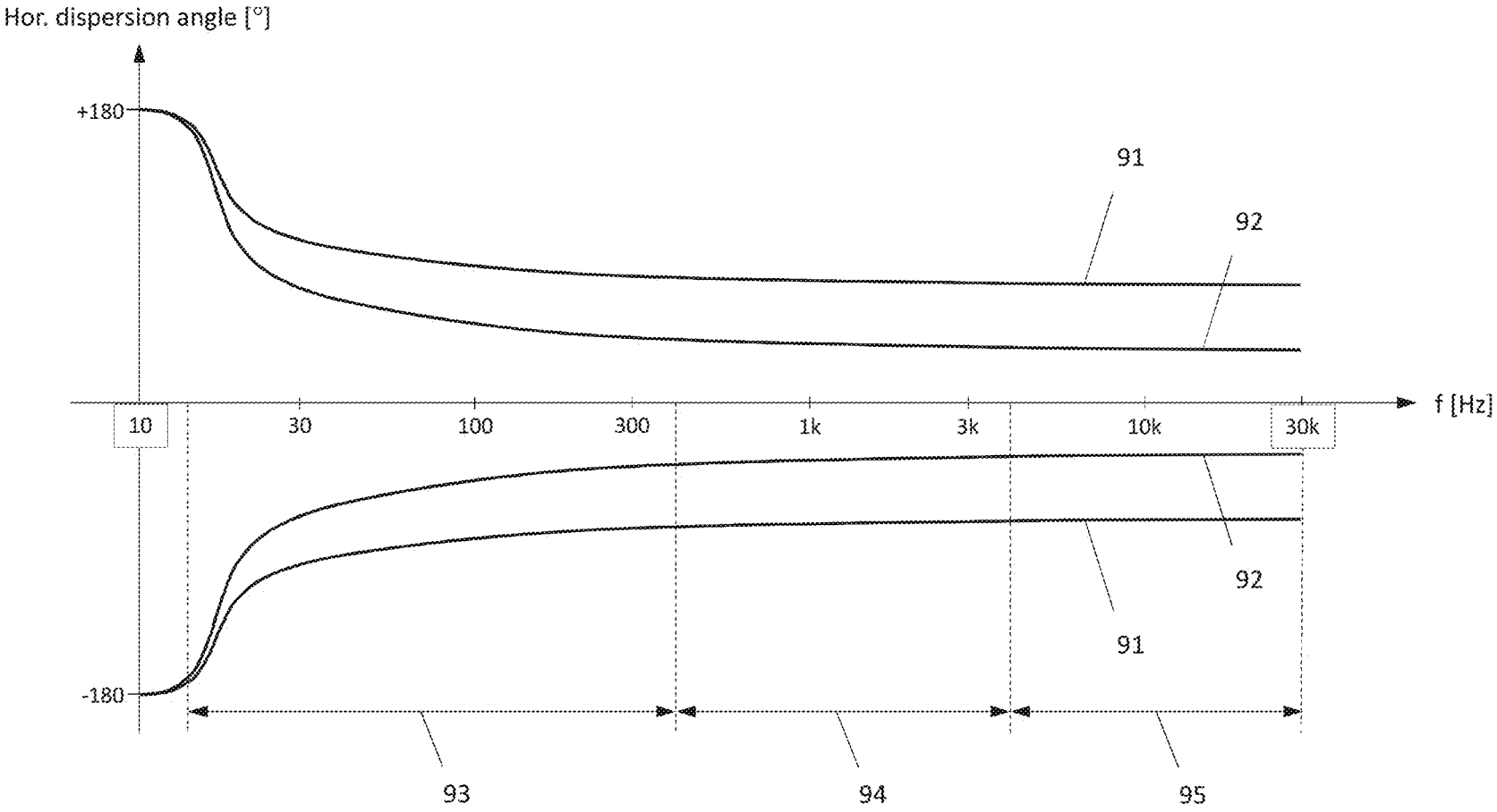

FIG. 10 illustrates the controlled horizontal dispersion of the sound energy as a function of frequency.

Figure 11:
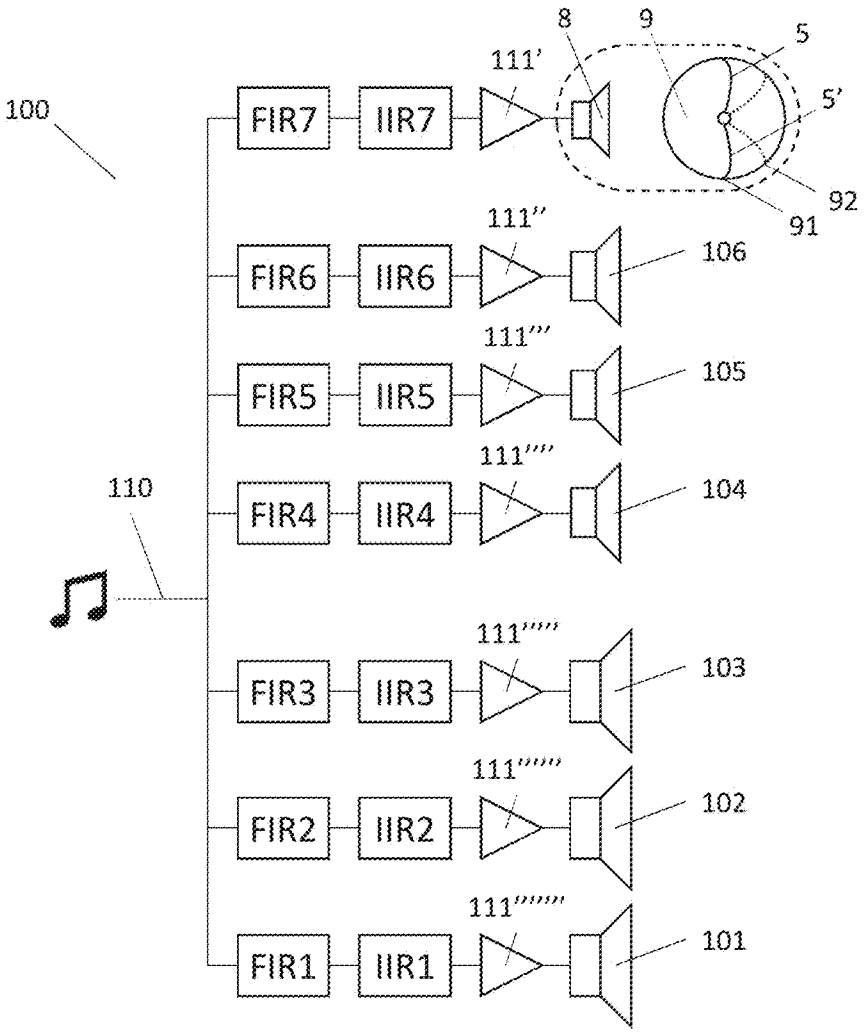

FIG. 11 illustrates a block diagram of a loudspeaker assembly.

DETAILED DESCRIPTION OF THE INVENTION

Figure 1:
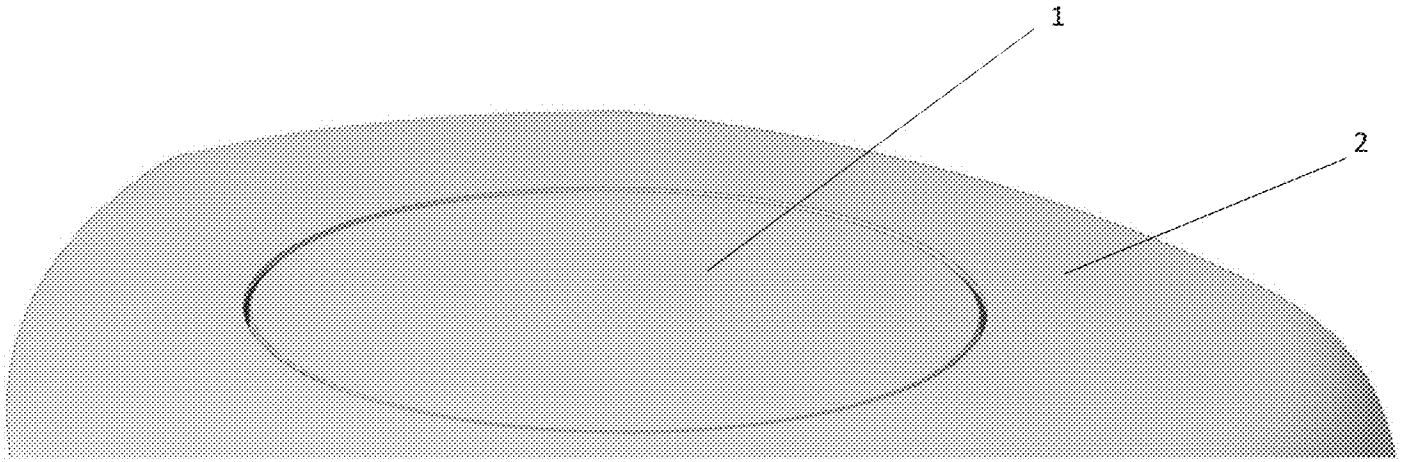
FIG. 1 illustrates a loudspeaker assembly including an acoustic lens.
Figure 2:
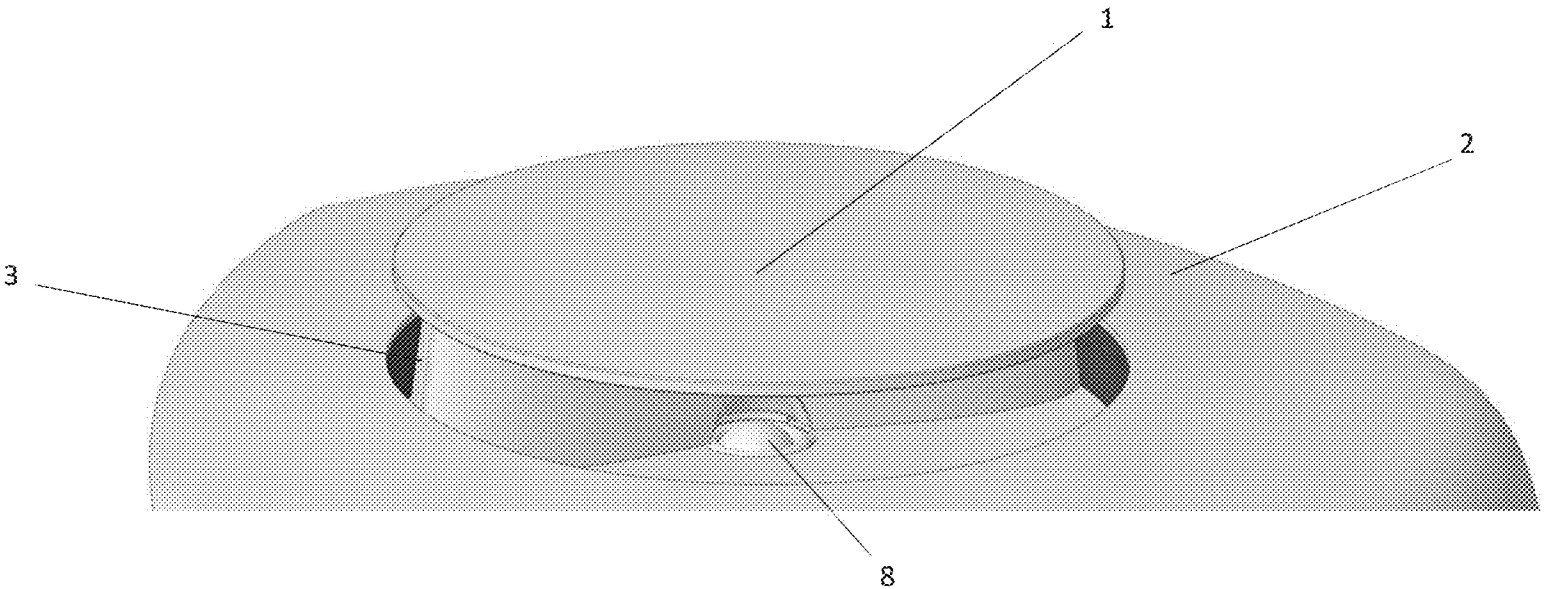
FIGS. 2 & 3 illustrate a loudspeaker assembly with the acoustic lens exposed.

FIG. 1 displays a loudspeaker assembly (2) according to the invention, where the assembly includes a tweeter built into an acoustic lens, and where the acoustic lens upper surface (1) is retracted into the surface of the loudspeaker assembly (2) and seamlessly integrates with the upper surface of loudspeaker assembly (2). FIG. 2 illustrates the acoustic lens (1), in an intermediate position during movement from a closed (non-exposed) position to an open position in which part of the sound transducer/tweeter (8) is visible. Sidewalls (3) of the acoustic lens are partly visible.

Figure 3:
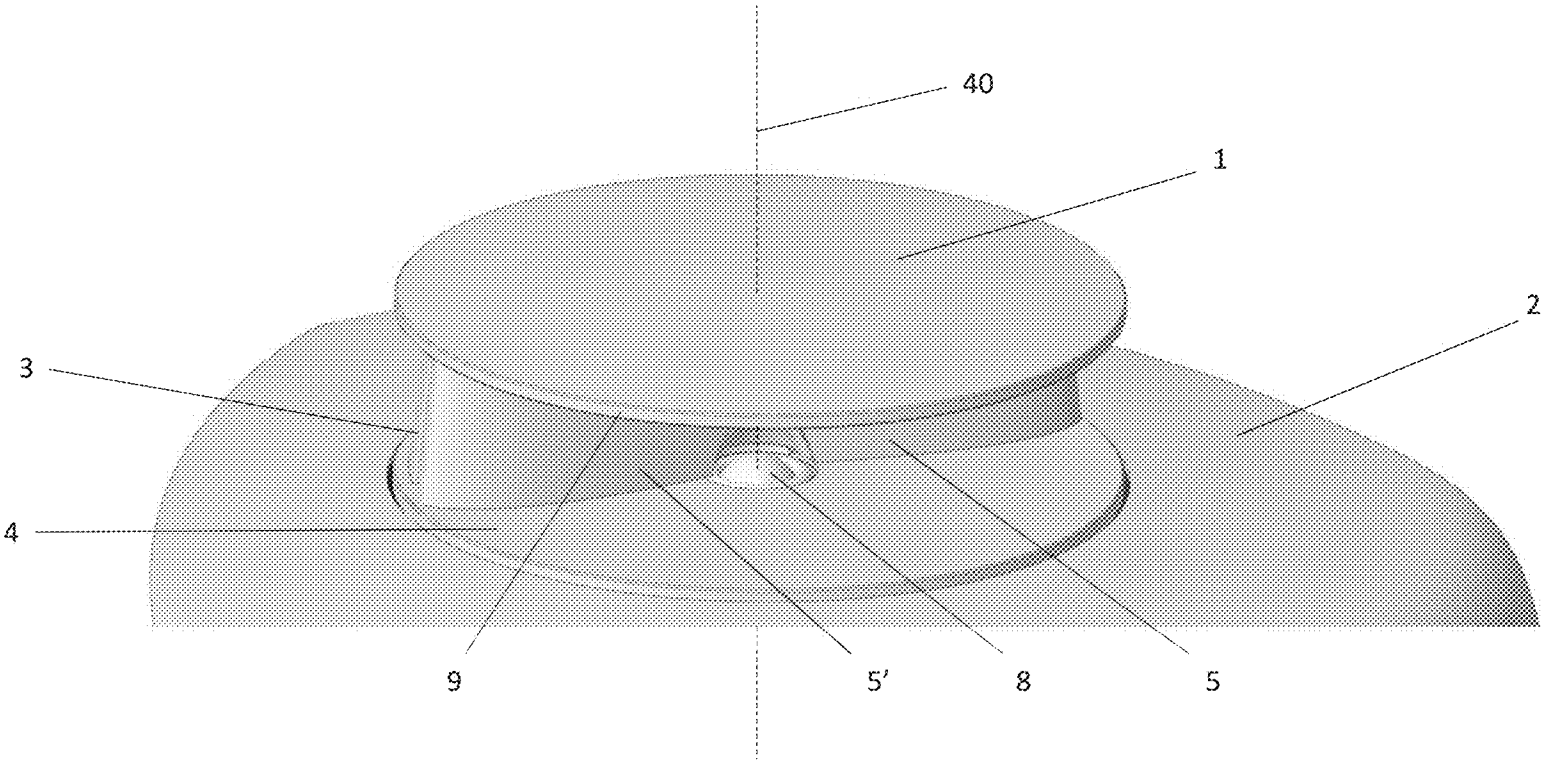

FIG. 3 illustrates the acoustic lens (1), in an open (exposed) position in which the tweeter (8) is visible. Sidewalls (3) of the acoustic lens are partly exposed. Part of the bottom plate (4) of the acoustic lens and a lower part (9) of the top plate (1) define a gap enabled to control the dispersion of sound emitted out from the acoustic lens, particularly vertically. The tweeter's direction of sound emission is illustrated by the dashed axis (40).

Figure 4:
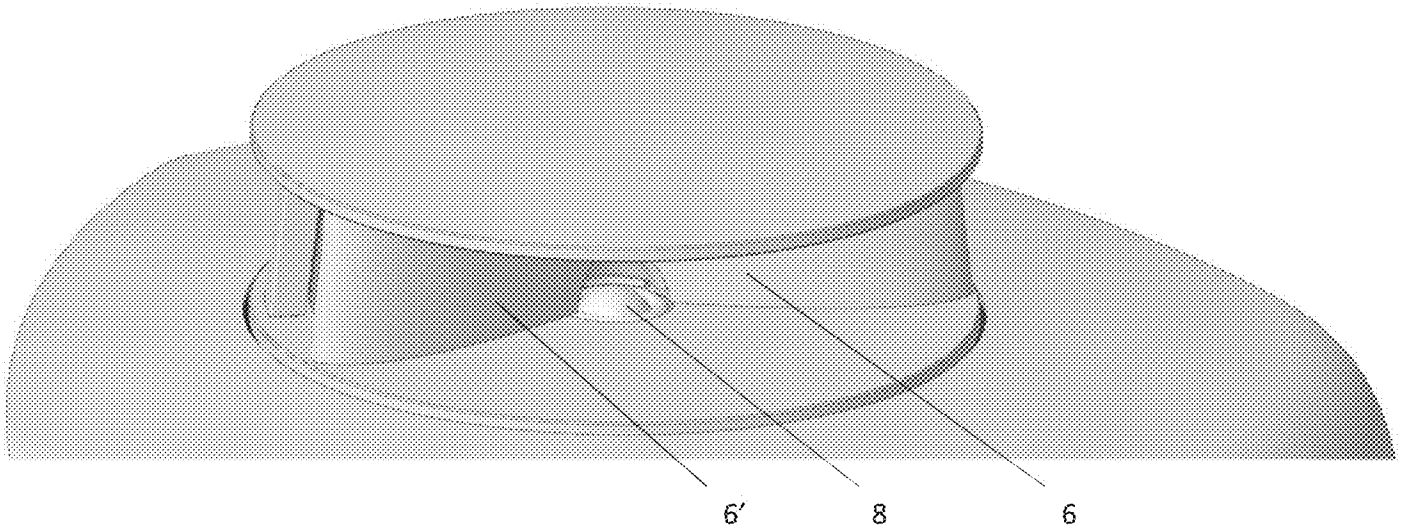
FIGS. 4 & 5 illustrate alternative positions of an acoustic lens.
Figure 5:
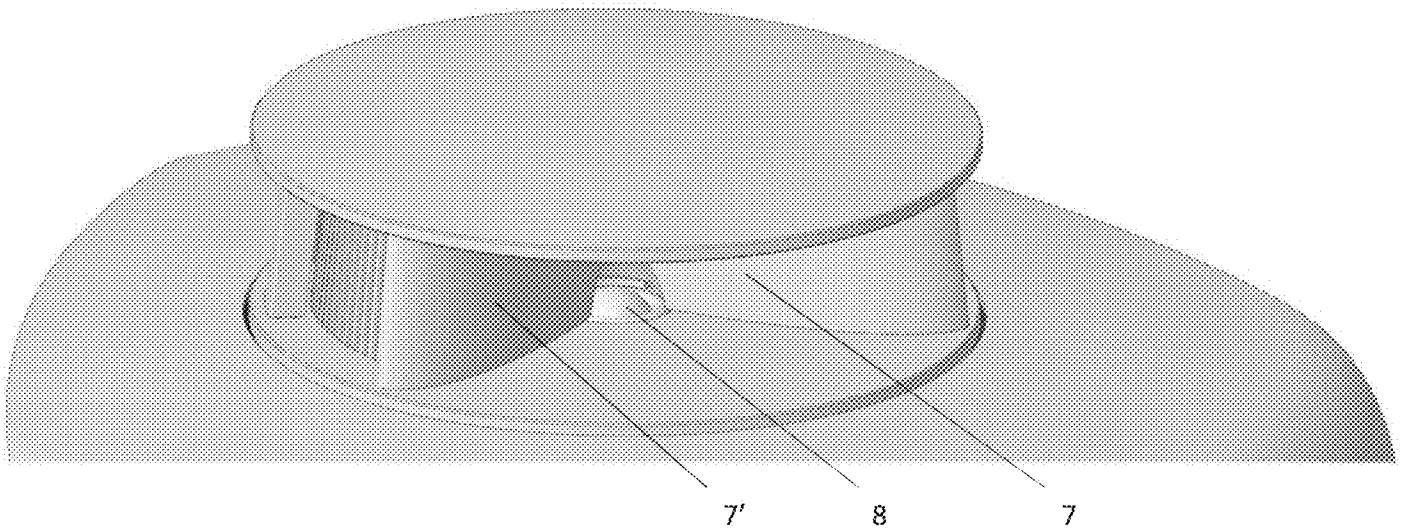

In FIGS. 3, 4 and 5, the acoustic lens is enabled with movable members (5, 5', 6, 6', 7, 7') where in a first position (5,5') a first mode with wide directivity is enabled and in a second exposed position (6,6') a second mode with a narrower directivity is enabled and in a third mode with an exposed position (7,7') a furthermore narrower directivity is enabled. For illustration purposes only, the means for bringing the acoustic lens according to the present invention from its first to its second and third modes/positions are not depicted, as any suitable means for providing the movement may be applied.

FIG. 6*a* displays an embodiment of the electromechanical means enabled for moving the movable members (61,62) that control the horizontal directivity of the distributed sound coming from the tweeter (8). The means include at least one motor (63), and combinations of tooth wheels (65) and/or friction wheels (67) and/or drive wheels (66) engaging with means (64) that connects to the movable members (5,5' & 6,6' & 7,7'). Hinge means (68) connects to the two members (61,62) and enables the rotation around a common axis (60), of said members. In the illustrated embodiment, a symmetrical (coupled) movement of the movable members (61,62) is achieved, e.g. such that the emitted sound will be emitted symmetrically (horizontally in use). However, it is also possible to construct a movement mechanism creating an asymmetrical (independent) movement of the two movable members (61,62). This may for example be by coupling each of the movable members to separate actuators, stepmotors or the like.

In FIG. 6*b* is illustrated a view of an acoustic lens (1) according to the invention, where the top of the lens has been removed. The tweeter (8) is arranged substantially centrally in the lens (1), and the center axis (60) for rotation of the movable members (5,5') as illustrated in FIG. 6*a* is coinciding with the center axis (40) of the tweeter (8). As the movable members (5,5') are moved from their widest position—a position where the stops (45,45') are engaging the rear cover (44) at corresponding stops (46,46') into a position as illustrated the opening behind the convex surfaces (5,5') are covered by curved walls (43,43'). In this manner the acoustic lens, regardless of its directivity angle, i.e. the relative angle between the movable members and thereby the curved surfaces (5,5'), will always have a full outer surface because of the provision of the back cover (44), the curved walls, (43,43') and the convex surfaces (5,5').

FIG. 7 displays a perspective side view of the acoustic lens arrangement (1), with the top plate (9), the fixed side walls (3), the bottom plate (4), the movable members (5, 5') and the tweeter (8).

When constructing the movable acoustic lens, it is important to avoid wide gaps between the movable members and the top and bottom plates of the acoustic lens. Such wide gaps would lead to distortion of the sound. Furthermore, any cavities behind the movable members must be filled with sound absorbing material to avoid distortion of the sound due to any residual leakage of sound energy leaking through the remaining gaps.

Figure 8:
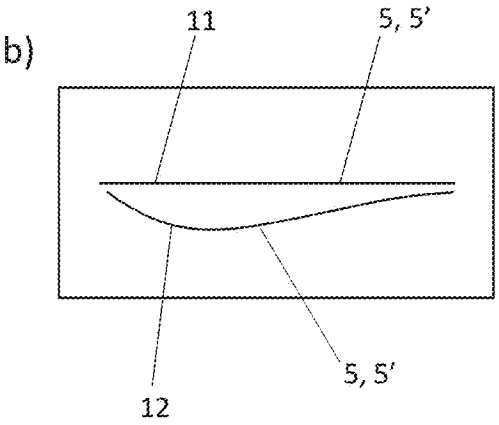
Figure 8:
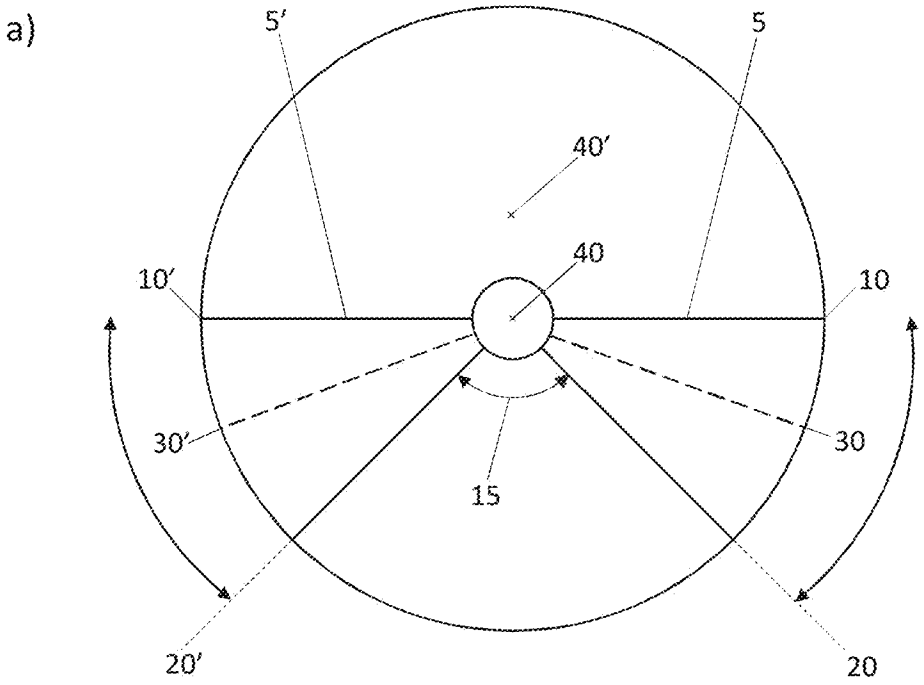

FIG. 8.*a* displays a top view of the acoustic lens with illustrations of the modes of directivity and related positions of the movable members (5,5'). The movable members (5,5') have center of rotation on a common axis (60) as illustrated in FIG. 6*a*. According to functional and/or industrial design requirements said center axis of rotation may be the same as the center axis (40) of the tweeter (8) or a center axis (40') offset and on a perpendicular line through the tweeter center (40).

The wide mode of directivity is (10', 10) with the movable members (5,5') in a closed position (first position).

The narrow mode of directivity is (20', 20) with the movable members (5,5') in an open position (second position).

In this connection "open" and "closed" positions refer to how exposed the movable members are. When the movable members are in their first position, they interfere the least with the emitted sound and vice-versa.

An intermediate mode of directivity is (30', 30) with the movable members (5,5') in a partly open position (third position). This represents a position during movement from first to second position. Optionally this mode is applied as a medium narrow mode of operation, delivering a medium narrow directivity. Anyway, any position of the movable members (5,5') between the most wide position (10,10') and the most narrow position (20,20') may be used. Also, any asymmetrical combination of relative positions between the movable members (5,5') may be used. This is particularly interesting in case the horizontal directivity is controlled and utilized. For example, one movable member (5) may be in position (10) while the other movable member (5') is in position (20'). In this configuration the acoustic lens will direct its sound emission towards the right (seen from the listener's position) as seen in FIG. 8*a*.

FIG. 8.*b* illustrates a top view of optional geometrical shapes of the movable members (5,5'). In one embodiment (11), a straight line defines the borderline. In an alternative embodiment (12) a curved line defines the borderline. Said curved lines being straight lines with starting points at center point (40) and the curved part of the lines having end points (10 and 10') at the periphery of the circle that includes the acoustic lens. The exact shape of the curved line can be complex and is determined by careful design, simulations and measurements with the goal of optimising the acoustic characteristics of the acoustic lens avoiding any unwanted effect on the sound reproduction.

FIG. 9 displays examples of sound radiation patterns representing the two modes of directivity operation being narrow (92) or wide (91) and with horizontal dispersion.

The illustration displays the sound radiation patterns as polar diagrams. The two polar diagrams have been normalized for the 0-degree direction. The polar area (25) corresponds to the narrow position (corresponding to 20,20'—see FIG. 8*a*) of the movable members (5,5'), whereas the polar area (26) illustrate the widest position (corresponding to (10,10')—see FIG. 8*a*) of the movable members.

FIG. 10 displays an example of the horizontal dispersion of sound emitted from the loudspeaker assembly that includes the acoustic lens according to the invention. The effect of the controlled directivity from the tweeter and the acoustic lens as an assembly is effective in the frequency range (95) from 4 kHz and above. The directivity in the low range frequencies (93) is controlled by the multiple low range loudspeaker transducers in combination with the appropriate filter settings. The directivity in the midrange frequencies (94) can be controlled by the multiple midrange loudspeaker transducers in combination with the appropriate filter settings or with an acoustic lens combined with a single midrange loudspeaker transducer.

In the embodiment of the invention disclosed in FIG. 11, the idea is to combine mechanical movement of the movable members of the acoustic lens with DSP control in order to control the sound dispersion of the total system.

The system 100 consists of three low range transducers (101,102,103) (woofers), three midrange transducers (104, 105,106), and a tweeter (8) mounted in a mechanical reflector—acoustic lens (9), that is able to change its shape, as explained above. In the figure, the acoustic lens (9) is illustrated in two different modes, a wide mode (91) and a narrow mode (92). These modes correspond to the positions of the movable members (5,5') as explained above with reference to for example FIG. 8*a*. The input signal (110) is filtered by FIR (Finite Impulse Response) and IIR (Infinite Impulse Response) filters before it is sent to separate power amplifiers 111'-111''''', connected to each transducer. The signal flow is shown in FIG. 11.

The system (100) gives the opportunity to change the directivity of the speaker assembly (100) at all frequencies. A mechanical movement that changes the shape of the acoustic lens (9) controls the tweeter directivity, see for example the radiation patterns in FIG. 9. In order to adapt the directivity of the woofers (101,102,103) and midrange transducers (104,105,106), the FIR and IIR filter coefficients are changed simultaneously such that the directivity of all sections (woofer, midrange and tweeter) match. The tweeter FIR and IIR filters are changed likewise such that the frequency responses of all sections align and sum up to the desired frequency response.

The narrow directivity target has a dispersion of for example +/−45° and the wide directivity target has a dispersion of for example +/−90° at a sound level of for example −3 dB compared to the on-axis sound level (0 dB). In FIG. 8*a* the accumulated directivity target, directivity angle is illustrated as the arc (15). Each mechanical angle has a corresponding filter set (see the table below) which matches the directivity of the tweeter in that specific angle.

It is of interest that the directivity is constant across frequencies. However, it is important that the directivity does not widen at higher frequencies. Therefore, the resulting directivity of the midranges should not be narrower than the tweeter directivity.

Generally seen the woofer section (101,102,103) operates below 400 Hz, the midrange (104,105,106) between 400 Hz and 4000 Hz, and the tweeter (8) above 4000 Hz. However, the frequency ranges are changeable to utilise the natural directivity of the drivers as much as possible.

The orders of the filters are not fixed. They depend on the physical realisation of the system, the precision demand, and the sampling rate.

In table 1 is illustrated the filter coefficients for two mechanical lens shapes. LFIRx denotes the FIR filter length of FIR filter x and LIIRy denotes the number of biquads in IIR filter y.

Table 1

| Filter | Narrow directivity | Wide directivity |
|---|---|---|
| FIR1 | $a_{FIR1_N_0}$, $a_{FIR1_N_1}$, . . . , $a_{FIR_1_N_LFIR1}$ | $a_{FIR1_W_0}$, $a_{FIR1_W_1}$, . . . , $a_{FIR1_W_LFIR1}$ |
| IIR1 | $b_{IIR1_N_1_0}$, $b_{IIR1_N_1_1}$, $b_{IIR1_N_1_2}$, $a_{IIR1_N_1_1}$, $a_{IIR1_N_1_2}$ | $b_{IIR1_W_1_0}$, $b_{IIR1_W_1_1}$, $b_{IIR1_W_1_2}$, $a_{IIR1_W_1_1}$, $a_{IIR1_W_1_2}$ |
| | $b_{IIR1_N_2_0}$, $b_{IIR1_N_2_1}$, $b_{IIR1_N_2_2}$, $a_{IIR1_N_2_1}$, $a_{IIR1_N_2_2}$ | $b_{IIR1_W_2_0}$, $b_{IIR1_W_2_1}$, $b_{IIR1_W_2_2}$, $a_{IIR1_W_2_1}$, $a_{IIR1_W_2_2}$ |
| | . . . | . . . |
| | $b_{IIR1_N_LIIR1_0}$, $b_{IIR1_N_LIIR1_1}$, $b_{IIR1_N_L_2}$, $a_{IIR1_N_LIIR1_1}$, $a_{IIR1_N_LIIR1_2}$ | $b_{IIR1_W_LIIR1_0}$, $b_{IIR1_W_LIIR1_1}$, $b_{IIR1_W_L_2}$, $a_{IIR1_W_LIIR1_1}$, $a_{IIR1_W_LIIR1_2}$ |
| FIR2 | $a_{FIR2_N_0}$, $a_{FIR2_N_1}$, . . . , $a_{IIR2_N_LFIR2}$ | $a_{FIR2_W_0}$, $a_{FIR2_W_1}$, . . . , $a_{FIR2_W_LFIR2}$ |
| IIR2 | $b_{IIR2_N_1_0}$, $b_{IIR2_N_1_1}$, $b_{IIR2_N_1_2}$, $a_{IIR2_N_1_1}$, $a_{IIR2_N_1_2}$ | $b_{IIR2_W_1_0}$, $b_{IIR2_W_1_1}$, $b_{IIR2_W_1_2}$, $a_{IIR2_W_1_1}$, $a_{IIR2_W_1_2}$ |
| | $b_{IIR2_N_2_0}$, $b_{IIR2_N_2_1}$, $b_{IIR2_N_2_2}$, $a_{IIR2_N_2_1}$, $a_{IIR2_N_2_2}$ | $b_{IIR2_W_2_0}$, $b_{IIR2_W_2_1}$, $b_{IIR2_W_2_2}$, $a_{IIR2_W_2_1}$, $a_{IIR2_W_2_2}$ |
| | . . . | . . . |
| | $b_{IIR2_N_LIIR2_0}$, $b_{IIR2_N_LIIR2_1}$, $b_{IIR2_N_L_2}$, $a_{IIR2_N_LIIR2_1}$, $a_{IIR2_N_LIIR2_2}$ | $b_{IIR2_W_LIIR2_0}$, $b_{IIR2_W_LIIR2_1}$, $b_{IIR2_W_L_2}$, $a_{IIR2_W_LIIR2_1}$, $a_{IIR2_W_LIIR2_2}$ |
| FIR3 | $a_{FIR3_N_0}$, $a_{FIR3_N_1}$, . . . , $a_{FIR3_N_LFIR3}$ | $a_{FIR3_W_0}$, $a_{FIR3_W_1}$, . . . , $a_{FIR3_W_LFIR3}$ |
| IIR3 | $b_{IIR3_N_1_0}$, $b_{IIR3_N_1_1}$, $b_{IIR3_N_1_2}$, $a_{IIR3_N_1_1}$, $a_{IIR3_N_1_2}$ | $b_{IIR3_W_1_0}$, $b_{IIR3_W_1_1}$, $b_{IIR3_W_1_2}$, $a_{IIR3_W_1_1}$, $a_{IIR3_W_1_2}$ |
| | $b_{IIR3_N_2_0}$, $b_{IIR3_N_2_1}$, $b_{IIR3_N_2_2}$, $a_{IIR3_N_2_1}$, $a_{IIR3_N_2_2}$ | $b_{IIR3_W_2_0}$, $b_{IIR3_W_2_1}$, $b_{IIR3_W_2_2}$, $a_{IIR3_W_2_1}$, $a_{IIR3_W_2_2}$ |
| | . . . | . . . |
| | $b_{IIR3_N_LIIR3_0}$, $b_{IIR3_N_LIIR3_1}$, $b_{IIR3_N_L_2}$, $a_{IIR3_N_LIIR3_1}$, $a_{IIR3_N_LIIR3_2}$ | $b_{IIR3_W_LIIR3_0}$, $b_{IIR3_W_LIIR3_1}$, $b_{IIR3_W_L_2}$, $a_{IIR3_W_LIIR3_1}$, $a_{IIR3_W_LIIR3_2}$ |
| FIR4 | $a_{FIR4_N_0}$, $a_{FIR4_N_1}$, . . . , $a_{FIR4_N_LFIR4}$ | $a_{FIR4_W_0}$, $a_{FIR4_W_1}$, . . . , $a_{FIR4_W_LFIR4}$ |
| IIR4 | $b_{IIR4_N_1_0}$, $b_{IIR4_N_1_1}$, $b_{IIR4_N_1_2}$, $a_{IIR4_N_1_1}$, $a_{IIR4_N_1_2}$ | $b_{IIR4_W_1_0}$, $b_{IIR4_W_1_1}$, $b_{IIR4_W_1_2}$, $a_{IIR4_W_1_1}$, $a_{IIR4_W_1_2}$ |
| | $b_{IIR4_N_2_0}$, $b_{IIR4_N_2_1}$, $b_{IIR4_N_2_2}$, $a_{IIR4_N_2_1}$, $a_{IIR4_N_2_2}$ | $b_{IIR4_W_2_0}$, $b_{IIR4_W_2_1}$, $b_{IIR4_W_2_2}$, $a_{IIR4_W_2_1}$, $a_{IIR4_W_2_2}$ |
| | . . . | . . . |
| | $b_{IIR4_N_LIIR4_0}$, $b_{IIR4_N_LIIR4_1}$, $b_{IIR4_N_L_2}$, $a_{IIR4_N_LIIR4_1}$, $a_{IIR4_N_LIIR4_2}$ | $b_{IIR4_W_LIIR4_0}$, $b_{IIR4_W_LIIR4_1}$, $b_{IIR4_W_L_2}$, $a_{IIR4_W_LIIR4_1}$, $a_{IIR4_W_LIIR4_2}$ |
| FIR5 | $a_{FIR5_N_0}$, $a_{FIR5_N_1}$, . . . , $a_{FIR5_N_LFIR5}$ | $a_{FIR5_W_0}$, $a_{FIR5_W_1}$, . . . , $a_{FIR5_W_LFIR5}$ |
| IIR5 | $b_{IIR5_N_1_0}$, $b_{IIR5_N_1_1}$, $b_{IIR5_N_1_2}$, $a_{IIR5_N_1_1}$, $a_{IIR5_N_1_2}$ | $b_{IIR5_W_1_0}$, $b_{IIR5_W_1_1}$, $b_{IIR5_W_1_2}$, $a_{IIR5_W_1_1}$, $a_{IIR5_W_1_2}$ |
| | $b_{IIR5_N_2_0}$, $b_{IIR5_N_2_1}$, $b_{IIR5_N_2_2}$, $a_{IIR5_N_2_1}$, $a_{IIR5_N_2_2}$ | $b_{IIR5_W_2_0}$, $b_{IIR5_W_2_1}$, $b_{IIR5_W_2_2}$, $a_{IIR5_W_2_1}$, $a_{IIR5_W_2_2}$ |
| | . . . | . . . |
| | $b_{IIR5_N_LIIR5_0}$, $b_{IIR5_N_LIIR5_1}$, $b_{IIR5_N_L_2}$, $a_{IIR5_N_LIIR5_1}$, $a_{IIR5_N_LIIR5_2}$ | $b_{IIR5_W_LIIR5_0}$, $b_{IIR5_W_LIIR5_1}$, $b_{IIR5_W_L_2}$, $a_{IIR5_W_LIIR5_1}$, $a_{IIR5_W_LIIR5_2}$ |
| FIR6 | $a_{FIR6_N_0}$, $a_{FIR6_N_1}$, . . . , $a_{IIR6_N_LFIR6}$ | $a_{FIR6_W_0}$, $a_{FIR6_W_1}$, . . . , $a_{FIR6_W_LFIR6}$ |
| IIR6 | $b_{IIR6_N_1_0}$, $b_{IIR6_N_1_1}$, $b_{IIR6_N_1_2}$, $a_{IIR6_N_1_1}$, $a_{IIR6_N_1_2}$ | $b_{IIR6_W_1_0}$, $b_{IIR6_W_1_1}$, $b_{IIR6_W_1_2}$, $a_{IIR6_W_1_1}$, $a_{IIR6_W_1_2}$ |
| | $b_{IIR6_N_2_0}$, $b_{IIR6_N_2_1}$, $b_{IIR6_N_2_2}$, $a_{IIR6_N_2_1}$, $a_{IIR6_N_2_2}$ | $b_{IIR6_W_2_0}$, $b_{IIR6_W_2_1}$, $b_{IIR6_W_2_2}$, $a_{IIR6_W_2_1}$, $a_{IIR6_W_2_2}$ |
| | . . . | . . . |
| | $b_{IIR6_N_LIIR6_0}$, $b_{IIR6_N_LIIR6_1}$, $b_{IIR6_N_L_2}$, $a_{IIR6_N_LIIR6_1}$, $a_{IIR6_N_LIIR6_2}$ | $b_{IIR6_W_LIIR6_0}$, $b_{IIR6_W_LIIR6_1}$, $b_{IIR6_W_L_2}$, $a_{IIR6_W_LIIR6_1}$, $a_{IIR6_W_LIIR6_2}$ |
| FIR7 | $a_{FIR7_N_0}$, $a_{FIR7_N_1}$, . . . , $a_{FIR7_N_LFIR7}$ | $a_{FIR7_W_0}$, $a_{FIR7_W_1}$, . . . , $a_{FIR7_W_LFIR7}$ |
| IIR7 | $b_{IIR7_N_1_0}$, $b_{IIR7_N_1_1}$, $b_{IIR7_N_1_2}$, $a_{IIR7_N_1_1}$, $a_{IIR7_N_1_2}$ | $b_{IIR7_W_1_0}$, $b_{IIR7_W_1_1}$, $b_{IIR7_W_1_2}$, $a_{IIR7_W_1_1}$, $a_{IIR7_W_1_2}$ |
| | $b_{IIR7_N_2_0}$, $b_{IIR7_N_2_1}$, $b_{IIR7_N_2_2}$, $a_{IIR7_N_2_1}$, $a_{IIR7_N_2_2}$ | $b_{IIR7_W_2_0}$, $b_{IIR7_W_2_1}$, $b_{IIR7_W_2_2}$, $a_{IIR7_W_2_1}$, $a_{IIR7_W_2_2}$ |
| | . . . | . . . |
| | $b_{IIR7_N_LIIR7_0}$, $b_{IIR7_N_LIIR7_1}$, $b_{IIR7_N_L_2}$, $a_{IIR7_N_LIIR7_1}$, $a_{IIR7_N_LIIR7_2}$ | $b_{IIR7_W_LIIR7_0}$, $b_{IIR7_W_LIIR7_1}$, $b_{IIR7_W_L_2}$, $a_{IIR7_W_LIIR7_1}$, $a_{IIR7_W_LIIR7_2}$ |

For all the embodiments described with reference to any of the figures, the loudspeaker assembly may advantageously be equipped with an impact sensing system such that if the loudspeaker assembly detects an impact for example in the shape of a hand or other body part being placed or hit upon the loudspeaker assembly (1), it may automatically and optionally retract into the first non-exposed position or return to the second exposed position depending on the location and the nature of the impact, thereby protecting both the loudspeaker assembly according to the invention, but also the body part.

The invention claimed is:

1. A loudspeaker assembly comprising:

an acoustic lens having one or more movable members, where said movable members may be moved from a first position where the movable members have a first influence on a directivity of the acoustic lens, to a second position where the movable members have a second influence on the directivity of the acoustic lens, and said movable members being movable in any position in-between said first position and said second position; and a sound transducer arranged adjacent the acoustic lens for emitting sound in a first direction, and where the movable members rotate around one or more first axes parallel to the first direction.

2. The loudspeaker assembly according to claim 1, wherein:

the movable members have a front surface having an extent in a direction of the one or more first axes and an extent in a direction radially to the one or more first axes, and where a movable member of said one or more movable members arranged in a radial direction to the one or more first axes has a curved shape.

3. The loudspeaker assembly according to claim 2 wherein:

the curved shape is convex, as seen from a listening position.

4. The loudspeaker assembly according to claim 1, wherein:

the movable members are moved by electromechanical means.

5. The loudspeaker assembly according to claim 1, further including:

one or more low range transducers;

one or more midrange transducers;

at least one acoustic lens with a high range transducer; and wherein signals delivered from a first amplifier to each of the one or more low range transducers, the one or more midrange transducers, and the at least one acoustic lens and sound transducer, is passed through a finite impulse response filter and through an infinite impulse response filter for each of the one or more low range transducers, one or more midrange transducers, and the at least one acoustic lens and sound transducer.

6. The loudspeaker assembly according to claim 5 wherein:

the signals after having passed through the finite impulse response filter and the infinite impulse response filter for each of the one or more low range transducers, one or more midrange transducers, and the at least one acoustic lens with sound transducer is sent to a separate second power amplifier connected to each of the one or more low range transducers, the one or more midrange transducers, and the at least one acoustic lens with sound transducer.

7. The loudspeaker assembly according to claim 5 wherein the assembly includes two acoustic lenses, where a first acoustic lens is provided for higher frequencies corresponding to treble and a second acoustic lens is provided for mid-tone frequencies.

8. The loudspeaker assembly according to claim 1 wherein:

the one or more movable members include two movable members, and where the two movable members move symmetrically or asymmetrically around their respective axis of the one or more first axes.

9. The loudspeaker assembly according to claim 1 wherein:

the loudspeaker assembly is arranged in a housing, and where the acoustic lens is retractable into the housing.

10. The loudspeaker assembly according to claim 1 wherein:

the acoustic lens is provided with light emitting means that may be controlled to emit different colored light and/or different light intensity corresponding to a status of the loudspeaker assembly.

* * * * *